US009947154B2

(12) United States Patent
Davis et al.

(10) Patent No.: US 9,947,154 B2
(45) Date of Patent: Apr. 17, 2018

(54) RETROFITTED KEYPAD AND METHOD

(71) Applicant: ASSA ABLOY AB, Stockholm (SE)

(72) Inventors: Masha Leah Davis, Austin, TX (US); Mark Robinton, Eden Prairie, MN (US)

(73) Assignee: ASSA ABLOY AB (SE)

( * ) Notice: Subject to any disclaimer, the term of this patent is extended or adjusted under 35 U.S.C. 154(b) by 0 days.

(21) Appl. No.: 15/255,575

(22) Filed: Sep. 2, 2016

(65) Prior Publication Data

US 2017/0061716 A1 Mar. 2, 2017

Related U.S. Application Data

(60) Provisional application No. 62/213,486, filed on Sep. 2, 2015.

(51) Int. Cl.
*G07C 9/00* (2006.01)

(52) U.S. Cl.
CPC ..... *G07C 9/00111* (2013.01); *G07C 9/00174* (2013.01); *G07C 9/00309* (2013.01); *G07C 9/0069* (2013.01); *G07C 2009/00769* (2013.01); *G07C 2209/04* (2013.01)

(58) Field of Classification Search
CPC ..... G07C 9/00309; G07C 2009/00793; G07C 9/00111; G07C 2209/63; G07C 9/00103; G07C 9/00182; G07C 9/00571
USPC ..... 340/5.61
See application file for complete search history.

(56) References Cited

U.S. PATENT DOCUMENTS

| | | | | |
|---|---|---|---|---|
| 7,246,744 | B2 * | 7/2007 | O'Brien | G07C 9/00103 235/382 |
| 8,474,026 | B2 * | 6/2013 | Guthery | G06F 21/31 713/159 |
| 8,912,884 | B2 * | 12/2014 | Fisher | G07C 9/00571 235/382 |
| 9,069,770 | B2 * | 6/2015 | Werner | G06Q 30/0623 |
| 9,137,723 | B2 * | 9/2015 | Maguire | H04W 36/18 |
| 9,521,139 | B2 * | 12/2016 | Lee | H04L 63/0823 |
| 9,647,968 | B2 * | 5/2017 | Smullen | H04L 67/322 |

* cited by examiner

*Primary Examiner* — Mark Blouin
(74) *Attorney, Agent, or Firm* — Sheridan Ross P.C.

(57) ABSTRACT

Methods, devices, and systems are provided for retrofitting an existing access control system with one or more supplemental access devices that add access control capabilities to the existing system. A supplemental access device can be configured as a retrofit keypad. The retrofit keypad adds the ability for a user to provide additional credential and/or security information to an access control system via one or more interface keys on the retrofit keypad. The retrofit keypad may be a portable device such as an RFID device, wireless communication device, near field communication (NFC) device, etc., and/or combinations thereof.

20 Claims, 4 Drawing Sheets

RETROFITTED KEYPAD AND METHOD

CROSS REFERENCE TO RELATED APPLICATIONS

The present application claims the benefit of and priority to U.S. Provisional Application Ser. No. 62/213,486, filed on Sep. 2, 2015, entitled "Retrofitted Keypad and Method," the entire disclosure of which is hereby incorporated by reference, in its entirety, for all that it teaches and for all purposes.

FIELD OF THE DISCLOSURE

The present disclosure is generally directed to access control systems and more specifically to devices that are configured to provide access information for access control systems.

BACKGROUND

In general, access control systems rely upon lock and key principles to grant or deny access to a secure asset. Whether the keys are configured as physical keys presented to a mechanical lock or virtual keys presented to an access control unit, most keys include specific features or characteristics that are either recognized by or match lock features before access is granted to the asset. Some access control systems employ the use of various portable devices to maintain credential information for presentation to a reading device. The portable devices are generally configured to communicate with the reading device via wireless communication protocols.

One example of a portable device includes the radio frequency identification (RFID) device, such as a contactless smart card, key fob, or the like, to store credential information that can be used to gain access to an asset. When presented to a reader/interrogator, the smart card transmits the stored credential information for verification by the reader/interrogator. The reader/interrogator processes the credential information and determines if the smart card being presented is a valid smart card. If the reader/interrogator determines that credential information associated with the smart card is valid, then the reader/interrogator initiates any number of actions including allowing the holder of the smart card access to an asset protected thereby.

Another example of a portable device can include a wireless communication device, such as a mobile phone or smartphone. In this case, credential information may be stored in a memory associated with the mobile phone and communicated to a reading device using at least one wireless communication protocol available to the mobile phone.

As access control technology continually progresses, devices and communication protocols evolve to offer more security, portability, and interoperability. However, the benefits of this evolution may not be realized where legacy access control systems are currently installed. In particular, organizations having legacy equipment may not choose to replace a complete access control system to adopt new technology due, in part, to the costs associated with implementing the new technology across the entire system. For this reason, many organizations will continue to use a legacy access control systems despite critical security concerns and shortcomings. Some of the shortcomings associated with legacy systems can include decreased technical support, security vulnerabilities, limited functionality, and limited expandability, to name a few.

SUMMARY

It is with respect to the above issues and other problems that the embodiments presented herein were contemplated. In general, embodiments of the present disclosure provide methods, devices, and systems for retrofitting an existing access control system with one or more supplemental access devices to add access control capabilities to the existing system. In some embodiments, the supplemental access device may be configured as a retrofit keypad. The retrofit keypad may add the ability for a user to provide additional credential and/or security information to an access control system via one or more interface keys on the retrofit keypad. As can be appreciated, the retrofit keypad may be configured as a portable device (e.g., RFID device, wireless communication device, near field communication (NFC) device, etc., and/or combinations thereof). By way of example, a user may present a portable device to a reading device of an access control system. In this case, the access control system may determine that additional information is needed before an action (e.g., granting access, denying access, providing a message, etc.) can be performed by the access control system. The additional information may be provided by at least one retrofit keypad as provided herein.

In one embodiment, the retrofit keypad can include one or more user interface keys including, but not limited to, electrical and/or mechanical buttons, switches, actuators, etc. One example of user interface keys are keys commonly associated with a keypad, keyboard, and/or other user interface device. The retrofit keypad may utilize a wireless communications antenna to provide information to one or more components of an access control system. In some embodiments, each key of the retrofit keypad may utilize a specific antenna that is unique to a particular key of the retrofit keypad. In other words, each key may have its own antenna that is separate from any other antenna of the keypad. Additionally or alternatively, one or more keys of the retrofit keypad may utilize a common antenna. In any event, at least one antenna may be used to send signals from the retrofit keypad to one or more devices of the access control system.

The retrofit keypad may be associated with a reading device and/or a portable device. In some cases, the retrofit keypad may be configured to attach to a reading device. Typical attachments can include the use of adhesive, fasteners, locking features, mating features, interconnecting features, heat staked connections, welded connections, ultrasonic welded attachments, etc., and/or combinations thereof. The attachments may be disposed between at least one surface of the retrofit keypad and a surface of the reading device. It should be appreciated that the retrofit keypad need not be attached to the reading device to operate effectively, and as such, may be attached apart from a reading device. For example, the retrofit keypad may be located in any area within a wireless communication range of the reading device.

A retrofit keypad associated with a reading device can offer a number of benefits and advantages in an access control system. For example, a button of the retrofit keypad may be used as an "intercom" button. The intercom button may initiate an intercom communication between a user at the retrofit keypad and/or reader and another user/entity apart from the retrofit keypad and/or reader. As can be appreciated, using the intercom button may send a predefined message to a host. This message can include location data. The location data may be based on location information associated with the retrofit keypad and/or the reader. In some cases, the location may be based upon an identification of a reader that sent the intercom message. Such an embodiment, may allow a user or person outside of an access control system to communicate with another user or person inside the access control system. Additionally or alternatively, a button of the retrofit keypad may be used as a "bell" (e.g., a doorbell, etc.). In any event, the button of the retrofit keypad (when contacted, pressed, or actuated) can send a signal from the retrofit keypad to the reading device and the reading device may send a communication signal (e.g., intercom, bell, etc.) to another communication device.

The definitions of the keys of the retrofit keypad may be different for a user based on data associated with the portable device (e.g., an ID card, etc.) of the user. For example, a button labeled "1" may send data for button "3" which can create a keypad having a scrambling feature. At least one benefit to this scrambling feature may include thwarting spying attempts. For instance, spying on Wiegand keypad data is made more difficult due in part to the scrambled output data.

In one embodiment, the reading device may be configured to program one or more keys of the retrofit keypad. The programming may be performed by the reading device sending program data automatically. For instance, retrofit keypad may be preprogrammed with a key, or button, "position" field. Additionally or alternatively, one or more keys of the retrofit keypad may be programmed by polling the user which key, or button, is to be programmed.

In some embodiments, the retrofit keypad may be configured to attach to a portable device (e.g., mobile credentials, RFID card, NFC card, ID card, wireless communication device, etc.). Typical attachments can include the use of adhesive, fasteners, locking features, mating features, interconnecting features, heat staked connections, welded connections, ultrasonic welded attachments, etc., and/or combinations thereof. The attachments may be disposed between at least one surface of the retrofit keypad and a surface of the portable device. It should be appreciated that the retrofit keypad need not be attached to the portable device to operate effectively, and as such, may be attached apart from a portable device. For example, the retrofit keypad may be located in any area within a wireless communication range of the portable device.

In one example, at least one key of a retrofit keypad may be added to an ID card (e.g., portable device, etc.). The key may serve to offer security and/or anti-clone protection. The anti-clone protection may require a user to provide access information from at least two separate credentials (e.g., from the ID card and the at least one key, etc.). For instance, after the first credentials associated with an ID card are read by the reading device, the reading device may "look" for second credentials. The second credentials may be stored on the retrofit keypad and sent to the reading device via actuating the at least one key. The reading device may be configured to "look" for the second credentials within a certain period of time after the ID card is read. Additionally or alternatively, the at least one key of the retrofit keypad may be required to be actuated at substantially the same time as the ID card is read by the reading device.

As can be appreciated, a bump-and-clone attack cannot surreptitiously copy any information from the retrofit keypad as provided herein. For instance, at least one key of the retrofit keypad may be required to be actuated in order to provide information to a reading device. In some embodiments, the retrofit keypad may operate on a different frequency from an associated RFID or ID card (e.g., portable device, etc.). For example, the ID card may operate at 125 kHz while the retrofit keypad (or functionality enabled thereby) may operate at 13.56 MHz, or vice versa. In this example, the reading device may include multi-frequency technology configured to read information sent via multiple frequencies.

In some cases, the at least one key of the retrofit keypad may include a derived value from the portable device. As can be appreciated, such a derived value may serve to bind the at least one key of the retrofit keypad to the portable device. In legacy RFID readers, the logic for the at least one key of the retrofit keypad may be handled in the host with software. For instance, the host may be configured to only consider when the portable device (e.g., RFID, ID card, etc.) AND the at least one key of the retrofit keypad are read. In non-legacy (e.g., new) readers this logic may be handled in the reading device itself.

In some embodiments, at least one key of the retrofit keypad may be configured as a duress button. When the duress button is actuated a duress signal may be transmitted from the retrofit keypad to a reading device. The duress button may be associated with a particular key of the retrofit keypad and/or a time of actuation in order to provide a duress signal. By way of example, the duress button may be actuated after a card is read, when a card is read, or before a card is read by a reading device to provide a duress signal. In any event, the timing of actuation of the duress button may be configured to differentiate the duress function from one or more other functions. These one or more other functions may be associated with the same key when actuated at different times. Similar timing logic and/or key allocation may be used to associate a status of a user or condition of an access (e.g., entering an access point, exiting an access point, clocking-in, clocking-out, etc.) with the reading of the retrofit keypad information. This information may be stored in at least one memory of the access control system.

As provided herein, the retrofit keypad may be configured to operate in conjunction with one or more portable devices. In some embodiments, the portable devices may be provided by a manufacturer different from the retrofit keypad. It is at least one aspect of the present disclosure that the retrofit keypad may be combined with any other ID card to make a single combined card that is capable of operating on multiple access control systems. Additionally or alternatively, one or more of the keys of the retrofit keypad may be programmed for a specific access control system manufacturer. In this case, a first key may be assigned to a first manufacturer and include programming specific to that first manufacturer's access control system while a second key may be assigned to a second manufacturer and include programming specific to that second manufacturer's access control system, and so on.

In some embodiments, one or more of the keys of the retrofit keypad may be assigned to a specific application. For instance, a first key of the retrofit keypad (when actuated, contacted, or pressed) may provide a parking access card function while a second key (when actuated, contacted, or pressed) may provide a payment card function, and so on. In some embodiments, the base technology associated with the portable device may be required in conjunction with the retrofit keypad in order to operate (e.g., for additional security, etc.).

The retrofit keypad may include its own power source or use power provided from another source. In some embodiments, the retrofit keypad may include electronics that can be powered by a reading device. One example of such electronics may be a retrofit keypad having RFID components, (e.g., a capacitor, antenna, etc.). In this example, when the retrofit keypad is presented within an RFID field provided by the reading device, the reading device provides energy via the RFID field that can be stored in the capacitor of the retrofit keypad.

In one embodiment, at least one key of the retrofit keypad may be attached to a liner page or sheet during manufacture. The liner page may include at least one individual and/or common antenna that the at least one key connects to. In the event that the at least one key is forcibly removed from the retrofit keypad, the point at which the at least one key attaches to the liner page may be disturbed such that the at least one key can no longer function. In other words, the at least one key may be torn from a necessary operational component (e.g., the antenna, etc.), and as such, may be prevented from functioning alone. In some embodiments, the removal of the at least one key of the retrofit keypad may destroy a functionality of the retrofit keypad, the portable device, and/or the reading device.

The term "computer-readable medium," as used herein, refers to any tangible storage and/or transmission medium that participate in providing instructions to a processor for execution. Such a medium may take many forms, including but not limited to, non-volatile media, volatile media, and transmission media. Non-volatile media includes, for example, NVRAM, or magnetic or optical disks. Volatile media includes dynamic memory, such as main memory. Common forms of computer-readable media include, for example, a floppy disk, a flexible disk, hard disk, magnetic tape, or any other magnetic medium, magneto-optical medium, a CD-ROM, any other optical medium, punch cards, paper tape, any other physical medium with patterns of holes, a RAM, a PROM, and EPROM, a FLASH-EPROM, a solid state medium like a memory card, any other memory chip or cartridge, a carrier wave as described hereinafter, or any other medium from which a computer can read. A digital file attachment to e-mail or other self-contained information archive or set of archives is considered a distribution medium equivalent to a tangible storage medium. When the computer-readable media is configured as a database, it is to be understood that the database may be any type of database, such as relational, hierarchical, object-oriented, and/or the like. Accordingly, the disclosure is considered to include a tangible storage medium or distribution medium and prior art-recognized equivalents and successor media, in which the software implementations of the present disclosure are stored.

As used herein, a "credential" or "credential information" is any data, set of data, encryption scheme, key, and/or transmission protocol used by a particular mobile device to verify its authenticity with a reader and/or interrogator.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_0$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_0$).

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The terms "determine," "calculate," and "compute," and variations thereof, as used herein, are used interchangeably and include any type of methodology, process, mathematical operation, or technique.

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The term "module" as used herein refers to any known or later developed hardware, software, firmware, artificial intelligence, fuzzy logic, or combination of hardware and software that is capable of performing the functionality associated with that element.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Copyright and Legal Notices

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
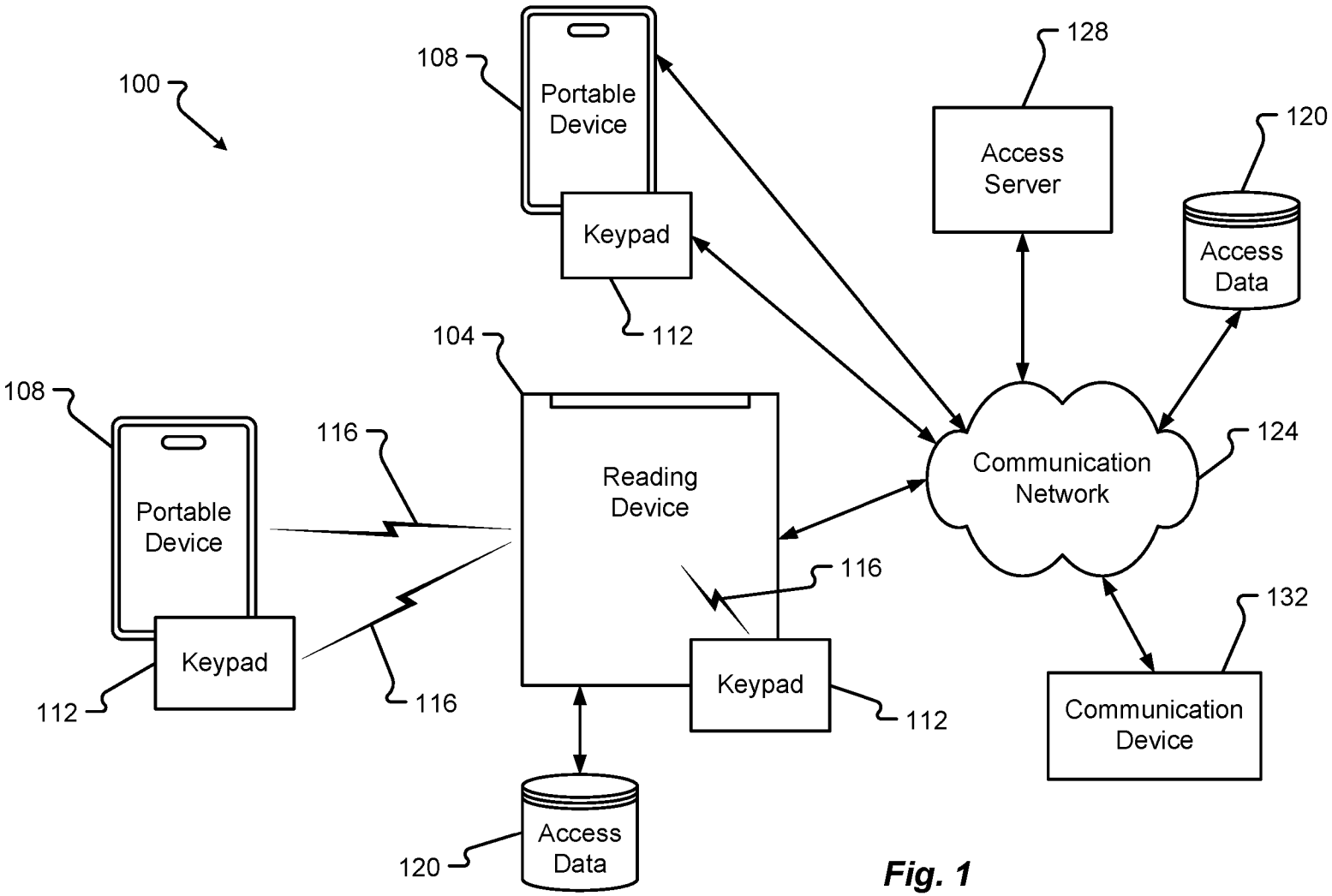
FIG. 1 is a diagram depicting an access control system in accordance with embodiments of the present disclosure.

FIG. 1 is a diagram depicting an access control system 100 for authenticating portable devices 108 in accordance with embodiments of the present disclosure. In one embodiment, the access control system 100 comprises at least one reading device 104, at least one portable device 108, and a retrofit keypad 112. The reading device 104 may include an access data memory 120. The access data memory 120 may be configured to store access information, identification data, rules, program instructions, and/or other data associated with performing access operations of an access control system 100. In some embodiments, the reading device 104 may be configured to communicate with an access data memory 120 across a communication network 124. The access data memory 120 may be located remotely, locally, and/or locally and remotely, from the reading device 104.

The portable device 108 and/or the retrofit keypad 112 may be configured to communicate with a reading device 104 across a wireless communication connection 116. The wireless communication connection 116 can include communication via at least one of conventional radio protocols, proximity-based wireless communication protocols, Bluetooth™, NFC, RF, and other wireless communication networks and/or protocols. In some cases, communications between the portable device 108 and the reading device 104 may be established automatically when the portable device 108 enters an active zone of an interrogating reading device 104. In one embodiment, the active zone of the reading device 104 may be defined as a three-dimensional space where the intensity of RF signals emitted by the reading device 108 exceeds a threshold of sensitivity of the portable device 108 and the intensity of RF signals emitted by the portable device 108 exceeds a threshold of sensitivity of the reading device 104.

In some embodiments, the portable device 108 and/or the retrofit keypad 112 may be configured to communicate with a reading device 104 across a communication network 124. The communication network 124 can include communication via at least one of conventional radio networks, wireless communication networks, Zig-Bee, GSM, CDMA, WiFi, and/or using other communication networks and/or protocols as provided herein.

In any event, communications between the retrofit keypad 112 and the reading device 108 may be established when at least one key of the retrofit keypad 112 is actuated, contacted, or pressed. In one embodiment, the actuation of at least one key of the retrofit keypad 112 may complete a circuit configured to initiate a communications ability of the retrofit keypad 112. In another embodiment, the actuation of the at least one key of the retrofit keypad 112 may initiate an instruction from a processor associated with the retrofit keypad 112 to send and/or receive an instruction to the reading device 104.

In one embodiment, authentication may be required between the reading device 104 and the retrofit keypad 112 before further communications are enabled. Additionally or alternatively, authentication may be required between the reading device 104 and the portable device 108 before further communications are enabled. In any event, the further communications may provide communications in which access control information (e.g., keys, codes, credentials, etc.) are shared. In some embodiments, the authentication may be provided via one-way or mutual authentication. Examples of authentication may include, but are not limited to, simple authentication based on site codes, trusted data formats, shared secrets, and/or the like. As can be appreciated, access control information is more sensitive and may require more involved validation via, for example, an encrypted exchange of access control information.

In some embodiments, the reading device 104 may be configured to request access control information from the portable device 108. This information may be used to validate the portable device 108. Validation may include referring to information stored in access data memory 120. Typically, a reading device 104 is associated with a particular asset (e.g., a door protecting access to a secure room, a computer lock protecting sensitive information or computer files, a lock on a safe, and the like). In one embodiment, the portable device 108 may be validated via one or more components of the access control system 100. Once the portable device 108 is authenticated, credential information associated with the portable device 108 and/or the retrofit keypad 112 may be validated. During this process, the reading device 104 may generate signals facilitating execution of the results of interrogating the portable device 108 (e.g., engages/disengages a locking mechanism, allows/disallows movement of a monitored article, temporarily disables itself, activates an alarm system, provides access to a computer system, provides access to a particular document, and the like). Alternatively, the access server 128 may generate such signals.

In accordance with embodiments of the present disclosure, the reading device 104 may collect access control information associated with the retrofit keypad 112 before an access control decision can be made. For example, the reading device 104 may require credential information stored on the retrofit keypad 112 to validate the retrofit keypad 112. The validity of the retrofit keypad 112 may be based on the validity of an associated portable device 108, or vice versa. In one embodiment, upon validating credential information stored on the retrofit keypad 112, the reading device 104 generates signals facilitating execution of the results of interrogating the retrofit keypad 112 and/or the portable device 108 (e.g., engages/disengages a locking mechanism, allows/disallows movement of a monitored article, temporarily disables itself, activates an alarm system, provides access to a computer system, provides access to a particular document, and the like). As provided above, the access server 128 may generate such signals.

The access server 128 may include a processor, a memory, and one or more inputs/outputs. The memory of the access server 128 may be used in connection with the execution of application programming or instructions by the processor, and for the temporary or long term storage of program instructions and/or data. As examples, the memory may comprise RAM, DRAM, SDRAM, or other solid state memory. Additionally or alternatively, the access server 128 may communicate with an access data memory 120. Like the memory of the access server 128, the access data memory 120 may comprise a solid state memory or devices. The access data memory 120 may comprise a hard disk drive or other random access memory.

In some embodiments, the reading device 104 may be configured to communicate with one or more devices across a communication network 124. For example, the reading device 104 may communicate with a portable device 108 and/or retrofit keypad 112 across the communication network 124. Among other things, this communication can allow for back-end authentication and/or provide notifications from the reading device 104 to the portable device 108. The communication network 124 may comprise any type of known communication medium or collection of communication media and may use any type of protocols to transport messages between endpoints. The communication network 124 may include wired and/or wireless communication technologies. The Internet is an example of the communication network 124 that constitutes an Internet Protocol (IP) network consisting of many computers, computing networks, and other communication devices located all over the world, which are connected through many telephone systems and other means. Other examples of the communication network 124 include, without limitation, a standard Plain Old Telephone System (POTS), an Integrated Services Digital Network (ISDN), the Public Switched Telephone Network (PSTN), a Local Area Network (LAN), a Wide Area Network (WAN), a Session Initiation Protocol (SIP) network, a Voice over Internet Protocol (VoIP) network, a cellular network, Wiegand, RS-232, similar networks used in access control systems between readers and control panels, and any other type of packet-switched or circuit-switched network known in the art. In addition, it can be appreciated that the communication network 124 need not be limited to any one network type, and instead may be comprised of a number of different networks and/or network types. Moreover, the communication network 124 may comprise a number of different communication media such as coaxial cable, copper cable/wire, fiber-optic cable, antennas for transmitting/receiving wireless messages, and combinations thereof In some embodiments, the access control system 100 may include at least one communication device 132. A communication device 132 may include, but is not limited to, a mobile phone, smartphone, smart watch, soft phone, telephone, intercom device, computer, tablet, mobile computer, alarm, bell, notification device, pager, and/or other device configured to convert received electrical and/or communication signals. In one embodiment, the communication device 132 may be used to receive communications sent from the retrofit keypad 112 via the reading device 104. For instance, a key of the retrofit keypad 112 may be used as an "intercom" button. The intercom button may initiate an intercom communication between a user at the retrofit keypad 112 and the communication device 132. Such an embodiment, may allow a user or person outside of the access control system 100 to communicate with another user or person inside the access control system 100. Additionally or alternatively, a button of the retrofit keypad 112 may be used to initiate a ring of the communication device 132 that can be configured to ring like a "bell" (e.g., a doorbell, etc.). In particular, the button of the retrofit keypad 112 (when contacted, pressed, or actuated) can send a wireless signal across a wireless communication connection 116 from the retrofit keypad 112 to the reading device 104 and the reading device 104 may then send a communication signal (e.g., intercom, bell, etc.) to the communication device 132 across the communication network 124. In some embodiments, the portable device 108 and the communication device 132 may be one and the same.

Figure 2:
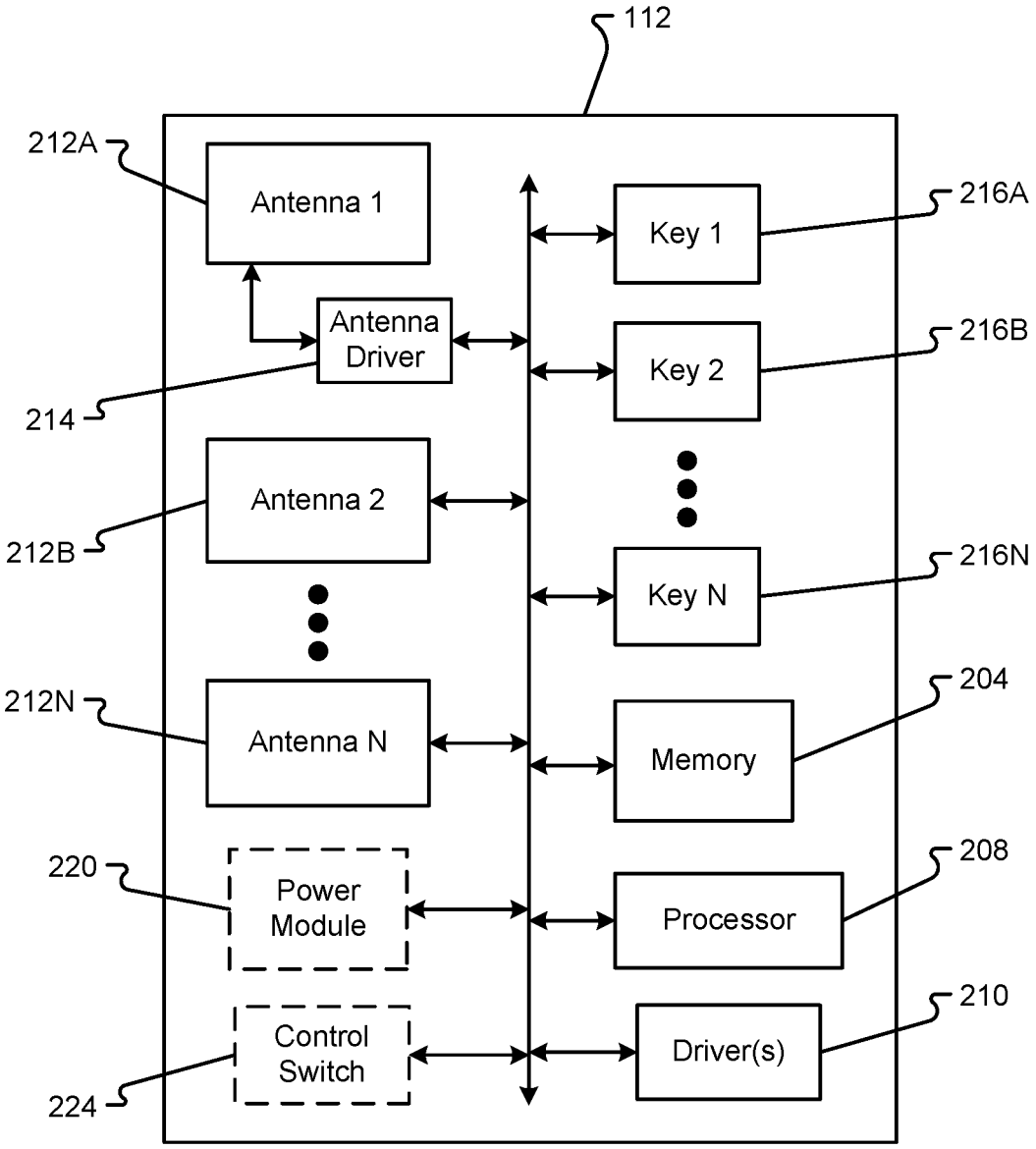
FIG. 2 is a block diagram depicting a retrofit keypad or components thereof in accordance with embodiments of the present disclosure.

Referring now to FIG. 2, a block diagram depicting a retrofit keypad 112 is shown in accordance with embodiments of the present disclosure. The retrofit keypad 112 may include a memory 204, a processor 208, at least one antenna 212A-N, and at least one key 216A-N. In some embodiments, the retrofit keypad 112 may further include a power module 220 and/or a control switch 224. The processor 208 may be an application specific integrated circuit (ASIC), microprocessor, programmable controller, or the like.

The memory 204 of the retrofit keypad 112 may be used in connection with the execution of application programming or instructions by the processor 208, and for the temporary or long term storage of program instructions and/or data. The memory 204 may contain executable functions that are used by the processor 208 to run other components of the retrofit keypad 112. In one embodiment, the memory 204 may be configured to store credential information. For instance, the credential information may include, but is not limited to, unique identifications, manufacturer identification, passwords, keys, encryption schemes, transmission protocols, and the like. As examples, the memory 204 may comprise RAM, DRAM, SDRAM, or other solid state memory.

The one or more antennas 212A-N may be configured to enable wireless communications between the retrofit keypad 112 and a reading device 104 and/or portable device 108. As can be appreciated, the antenna(s) 212A-N may be arranged to operate using one or more wireless communication protocols and operating frequencies including, but not limited to, Bluetooth®, NFC, Zig-Bee, GSM, CDMA, WiFi, RF, and the like. By way of example, the antenna(s) 212A-N may be RF antenna(s), and as such, may transmit RF signals through free-space to be received by a reading device 108 having an RF transceiver.

In some embodiments, the retrofit keypad 112 may include one or more interface keys 216A-N. The interface keys 216A-N may be electrical and/or mechanical buttons, switches, actuators, etc. One example of interface keys 216A-N are the physical keys commonly associated with a keypad, keyboard, and/or other user interface device. Another example of interface keys 216A-N include touch-sensitive keys that are commonly associated with a graphical user interface (GUI), for example, buttons presented to a touch-sensitive display, etc. In any event, the interface keys 216A-N are configured to receive input from a user. In some cases, input received from a user via an interface key 216A-N may be interpreted by the processor 208 and transmitted via an antenna 212A-N. In one embodiment, the interface keys 216A-N may utilize one or more drivers 210 that are connected to the one or more antennas 212A-N. The drivers 210 may include antenna drivers. For instance, different drivers 210 may be connected to various antennas 212A-N. As can be appreciated, one or more drivers 210 for the antennas 212A-N may act as the interface between the keypad and the antenna. By way of example, Antenna 1 212A may utilize antenna driver 214 in translating an input provided at an interface key 216A-N into a resonance that is associated with the antenna 212A.

It is anticipated that each interface key 216A-N may correspond to a specific output associated with that interface key 216A-N. The output associated with an interface key 216A-N may be stored in the memory 204 of the retrofit keypad 112 and/or in a memory associated with each interface key 216A-N. Typical outputs can include one or more of numbers, letters, signals, instructions, and the like.

For example, a retrofit keypad 112 can include an array of interface keys 216A-N configured as buttons on a number keypad. The number keypad could include numbers 0- 9 buttons and function key buttons (e.g., "*" and "#", etc.) similar, if not identical, to those buttons found on a Wiegand keypad. Continuing this example, a first interface key 216A may be associated with the number "1" button on the number keypad, while the second interface key 216B may be associated with the number "2" button on the number keypad, and so on. As such, when the first interface key 216A is pressed, the output may be the number "1."

As another example, the interface keys 216A-N may be associated with an application. For instance, a first interface key 216A may be associated with a parking RF device output. When the first interface key 216A is pressed, the processor 208 may determine that information for the parking RF device should be provided. This information may be stored in the memory 204 of the retrofit keypad 112. Continuing this example, the processor 204 may transmit the information for the parking RF device on the antenna 212A-N for the parking RF device.

As yet another example, the interface keys 216A-N may perform a first function at a first time/condition and a second different function at a second time/condition. For example, a first interface key 216A may be used to send credential information when the first interface key 216A is pressed at a first time of a condition (e.g., before, during, or after a reading device 104 reads a portable device 108, etc.). If the first interface key 216A is pressed within a predefined period of time of the condition, the first function is performed (e.g., by the processor 208 referring to the memory 204 and executing rules for the first function, etc.). In the event that the first interface key 216A is not pressed within a predefined time period of the condition, a second different function may be performed (e.g., by the processor 208 referring to the memory 204 and executing rules for the first function, etc.). Examples of first and/or second functions can include, but are not limited to, duress functions, alarm signaling, deactivating access, restricting access, allowing access with monitoring, sending messages, deactivating the retrofit keypad 112, combinations thereof, and the like. As can be appreciated, the interface keys 216A-N may have more than two functions (e.g., a third function at a third time, a fourth function at a fourth time, etc.) that are dependent on various times and/or condition associated with pressing a key 216A-N.

This functionality can offer a number of advantages and benefits over other identification credentials, cards, keypads, and/or access control systems. At least one benefit of the retrofit keypad 112 includes increasing security associated with access decisions. When employing multiple functionality for each interface key 216A-N, as provided above, proper use of the retrofit keypad 112 can depend on a user knowing which key 216A-N to press and what time to press the key 216A-N to perform a particular function. In secure scenarios, this embodiment of the retrofit keypad 112 provides another level of knowledge required by a user to effectively use the keypad 112. As can be appreciated, the theft of a retrofit keypad 112 alone would not be sufficient to allow a thief to gain access to a system (e.g., because the thief would not be aware of the timing, a condition, and/or a function associated with the interface keys 216A-N).

In any event, the interface keys 216A-N may use individual antennas 212A-N or a common antenna 212A-N to send a signal, or output, associated with the interface key 216A-N. For instance, each interface key 216A-N of the retrofit keypad 112 may utilize a specific antenna 212A-N that is unique to a particular interface key 216A-N of the retrofit keypad 112. In other words, each interface key 216A-N may have its own antenna 212A-N that is separate from any other antenna 212A-N of the keypad 112. In some cases, each antenna 212A-N may have its own driver 210 associated therewith. Additionally or alternatively, one or more interface keys of the retrofit keypad 112 may utilize a common antenna 212A-N. In one embodiment, the common antenna 212A-N may utilize a common driver 210. In any event, at least one antenna 212A-N may be used to send signals from the retrofit keypad 112 to one or more devices 104, 108, 128, 132 of the access control system 100.

Using the parking RF device example above, the first antenna 212A may be configured to operate on a frequency for the parking RF device. In this instance, the retrofit keypad 112 may determine to transmit the information for the parking RF device from the retrofit keypad 112 to a reading device 104 via the first antenna 212A.

In some embodiments, the retrofit keypad may include a power module 220. The power module 220 may be configured to provide power to the parts of the retrofit keypad 112 in order to operate. The power module 220 may store power in a capacitor of the power module. In one embodiment, electronics in the power module 220 may store energy in the capacitor and turn off when an RF field is present. This arrangement can ensure that energy is presented to the retrofit keypad 112 minimizing any effect on read distance. Although the retrofit keypad 112 may be configured to receive power passively from an electrical field of a reading device 104, it should be appreciated that the retrofit keypad 112 may provide its own power. For example, the power module 220 may include a battery or other power source to supply power to parts of the retrofit keypad 112.

Embodiments of the retrofit keypad 112 may include a control switch 224. The control switch 224 can include a setting for programming the one or more interface keys 216A-N of the retrofit keypad 112. For instance, when positioned to a "program" setting or mode, the retrofit keypad 112 may receive program instructions from a user and/or device (e.g., reading device 104, access server 128, etc.). Programming for the one or more interface keys 216A-N can be stored in the memory 204 and executed by the processor 208. In some embodiments, the control switch 224 can prevent unwanted write access to the retrofit keypad 112 by providing a physical switch that can be toggled between an "operational mode" and a "program mode." For example, when set to the program mode, the control switch 224 can prevent the retrofit keypad 112 from operating, and when set to the operational mode, the control switch can prevent the retrofit keypad 112 from being programmed. In one embodiment, the control switch 224 may include an "off" setting to deactivate the keypad 112 temporarily or permanently.

Figure 3:
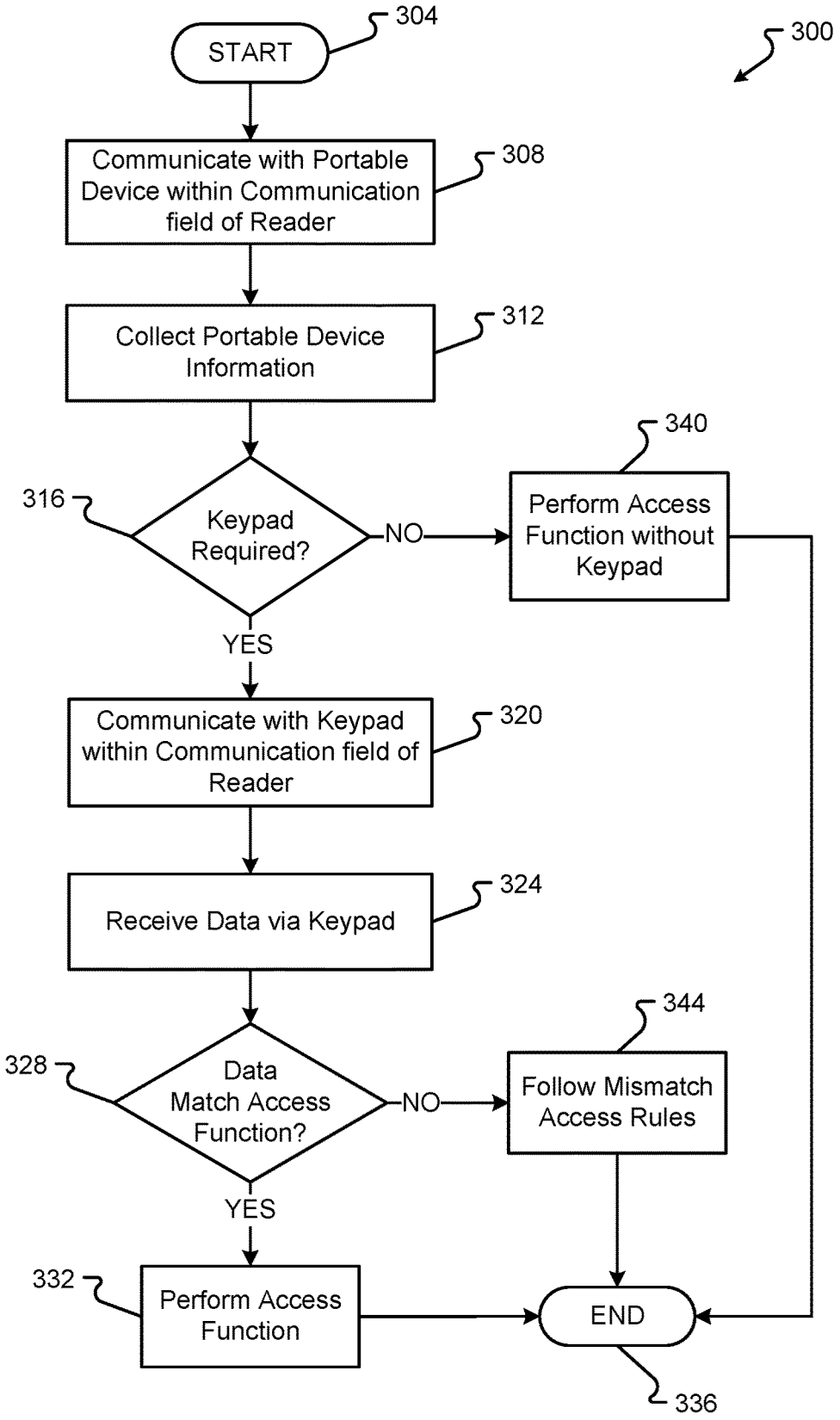
FIG. 3 is a flow chart depicting a first method of communicating with a portable device and retrofit keypad in accordance with embodiments of the present disclosure.

FIG. 3 is a flow chart depicting a first method 300 of communicating with a portable device 108 and retrofit keypad 112 in accordance with embodiments of the present disclosure. While a general order for the steps of the method 300 is shown in FIG. 3, the method 300 can include more or fewer steps or can arrange the order of the steps differently than those shown in FIG. 3. Generally, the method 300 starts with a start operation 304 and ends with an end operation 336. The method 300 can be executed as a set of computer-executable instructions executed by a computer system and encoded or stored on a computer readable medium. Hereinafter, the method 300 shall be explained with reference to the systems, components, modules, software, data structures, user interfaces, etc. described in conjunction with FIGS. 1 and 2.

The method 300 begins at step 304 and proceeds by communicating with a portable device 108 that is within a communication field of a reading device 104. The reading device 104 may be associated with (e.g., be combined with, a part of, near, and/or adjacent to) a retrofit keypad 112, and vice versa, as provided herein. In some embodiments, the communication may be performed by at least one reading device 104 of the access control system 100. As can be appreciated, the communication may be initiated by the reading device 104, the portable device 108, and/or other parts of the access control system 100. For instance, in one embodiment of an RF access control system, an RF reading device may provide an electrical field that initiates a communication with an RF portable device. In this example, when the RF portable device enters the electrical field of the RF reading device, communication between the RF portable device and the RF reading device is enabled. In some cases, the electrical field may provide an RF portable device with the necessary power to complete various communications operations.

In another embodiment, the reading device 104 may be a wireless access reader configured to communicate with portable devices 108 using Bluetooth® communications protocols (e.g., Bluetooth®, Bluetooth® low energy (LE), etc.). For example, the portable devices 108 in this embodiment may be mobile phones equipped with Bluetooth® communication hardware and software. Continuing this example, either the mobile phone or the wireless access reader may be the device that initiates commands and/or requests, as provided herein. As can be appreciated, the other device (e.g., the device not initiating commands and/or requests) may be configured to receive the commands and/or requests.

Next, the method 300 continues by collecting information from the portable device 108 (step 312). The collection of information may be made by one or more of the reading device 104, the access server 128, and another part of the access control system 100. Typical information collected from the portable device 108 can include, but is not limited to, credential information, identification information, portable device characteristics, and the like. One example of a portable device 108 may include an RFID card. In this example, the information collected may be credential information that is stored in a memory of the RFID card.

The method 300 continues by determining whether information from a retrofit keypad 112 is required (step 316). In some embodiments, a reading device 108 may be coupled with a retrofit keypad 112 and may require a user to provide information via the retrofit keypad 112 before an access decision is made by the access control system 100. In other words, use of the retrofit keypad 112 may be required by software of the reading device 104 and/or the access server 128. In one embodiment, the reading device 104 and/or the access server 128 may determine that further information is required based on the information collected from the portable device in step 312. For instance, the reading device 104, upon reading the portable device 108, may refer to an access server 128 and/or an access data memory 120 for access rules and/or instructions. In some cases, a user may be required to provide additional credential information (e.g., a password, personal identification number (PIN), code, other credential information, etc.) before an access decision can be made by the access control system 100. This requirement may be stored in the access data memory 120 of the access control system 100. If information from the retrofit keypad 112 is not required, the method 300 continues at step 340 by performing a typical access function (e.g., without the retrofit keypad 112). The method 300 then ends at step 336.

In the event that information from a retrofit keypad 112 is required, the method 300 proceeds by communicating with the retrofit keypad 112 within the communication field of the reading device 104 (step 320). In one embodiment, communications may be initiated by the reading device 104 sending an interrogation signal, command, or request to the retrofit keypad 112. In another embodiment, the retrofit keypad 112 may be initiated for communications by a signal sent from the reading device 104. For example, the reading device 104 may send a "power up" signal to the retrofit keypad 112. The retrofit keypad 112 may provide an illumination, a sound, and/or a combination thereof in response to receiving the signal (e.g., to indicate to a user that the retrofit keypad 112 can receive data, is powered up, etc.). In yet another embodiment, communications may be initiated by pressing at least one key 216A-N of the retrofit keypad 112. The communications between the reading device 104 and the retrofit keypad 112 may include a number of communications protocols and may be configured to suit the specifications/requirements of a particular access control system (e.g., RF, Bluetooth®, Bluetooth® LE, infrared, magnetic resonance, electrostatic, etc.).

Communicating with the retrofit keypad 112 may include sending information to the retrofit keypad 112 regarding encryption techniques. Encryption techniques may be used by the retrofit keypad 112 to, among other things, scramble data input at the keypad 112 and output from the keypad 112. For instance, the reading device 108 may send a particular substitution cipher command to the retrofit keypad 112 that is configured to scramble data entered at the keypad 112. By way of example, a button labeled "1" may send data for button "3" which can create a keypad 112 having a scrambling feature. At least one benefit to this scrambling feature may include thwarting spying attempts. As can be appreciated, spying on Wiegand keypad data may be made more difficult due in part to scrambled output data using these encryption techniques. The substitution cipher command, sent via the reading device 104, can provide stateful and/or random initialization vectors, or starting variables, to be used by the retrofit keypad 112. Additionally or alternatively, definitions of the one or more keys 212A-N of the retrofit keypad 112 may be different for a user based on data associated with a portable device 108 (e.g., an ID card, etc.) of the user (e.g., such as the portable device 108 read in steps 308-312 of the method 300).

Next, the method 300 continues when data is received via the retrofit keypad 112 (step 324). The data may be received at one or more of the reading device 104, the access server 128, and a part of the access control system 100. In some embodiments, the data is information provided by a user at the retrofit keypad 112. For example, when a user presses at least one key 216A-N of the retrofit keypad 112, a signal may be sent by the retrofit keypad 112 using at least one antenna 212A-N to the reading device 104. In one embodiment, signals may include information representing a string of data (e.g., a number of keys 216A-N pressed by a user) that are sent together (e.g., in a concatenated string) upon pressing a "send" or "final" key 216A-N of the keypad 112. In some embodiments, the data received may be associated with a time of transmission, reception, and/or combinations thereof. For example, data received may include a timestamp. The timing associated with sending/receiving data can be used to provide various functional operations as described herein.

In some embodiments, the method 300 may continue by determining whether at least some of the received data matches stored access information and/or an access function (step 328). Access information may be stored in an access data memory 120 of the access control system 100. For example, if credential information is provided via the retrofit keypad 112, the reading device 104 and/or the access server 128 may refer to a memory 120 to determine whether the credential information matches credential information stored in the memory 120. If a match exists, the method may continue at step 332 by performing an access function associated with the received data. In the event that a match does not exist (e.g., when there is a mismatch between data received via the keypad 112 and data stored in the memory 120) the method may continue at step 344 by following mismatch rules.

In one embodiment, the data received may be mapped to an access function of the access control system 100. For instance, an access function can include, but is not limited to, granting access, denying access, limiting access, providing restricted access, sending a message, initiating a communication with a communication device 132, sending an alarm, establishing an intercom communication, and the like. Additionally or alternatively, access functions may be associated with access information. For instance, an access function may be associated with a specific user and/or credential information. In some embodiments, an access function may be tied to a particular signal sent via the retrofit keypad 112.

In any embodiment, determining whether a match exists may be performed by at least one of the reading device 104 and the access server 128. The determination may include receiving a specific signal that corresponds to (e.g., matches) an access function of the system. Additionally or alternatively, the determination may include comparing data received to data stored in a memory of the access control system 100. If a match exists, the method 300 may continue at step 332 by performing an access function associated with the received data. In the event that a match does not exist (e.g., when there is a mismatch between data received via the keypad 112 and data stored in the memory 120) the method 300 may continue at step 344 by following mismatch rules.

Where the data received matches an access function, the method 300 continues by performing the access function (step 332). For example, a user may press an "intercom" key of the retrofit keypad 112. An intercom key signal may then be received by the reading device 104 and/or the access server 128 in step 324. In this example, the intercom key signal may include intercom instructions stored in memory. The reading device 104 and/or the access server 128 may then follow the intercom instructions and establish an intercom communication between the user at the retrofit keypad 112 and a communication device 132.

Another example, may include a user pressing a "doorbell" key of the retrofit keypad 112. In this case, the doorbell key signal may be received by the reading device 104 and/or the access server 128 as provided in step 324. The doorbell key signal may initiate a doorbell ringing function via the reading device 104 and/or the access server 128 following instructions stored in memory 120 that are associated with the doorbell key signal. In response, a doorbell (e.g., embodied as the communication device 132 of access control system 100) may provide an audible and/or visual alert.

As yet another example, a user may provide a code via the retrofit keypad 112 that is received by the reading device 104 and/or the access server 128 in step 324. The code may be matched to a code stored in memory. Based at least partially on the match, the access control system 100 may perform the function of granting access to an asset of the access control system 100. This function may include unlocking a door, providing access to an area, providing access to a resource (e.g., computational, physical, storage, etc.), allowing egress or ingress, and/or providing other access functions.

In the event that the data received does not match an access function, the method 300 proceeds by following mismatch access rules stored in memory (step 344). The mismatch rules may be stored in the access data memory 120 of the access control system 100. For example, a user may enter a code via the keypad 112 that fails to match data stored in memory 120. In following the rules store in memory 120, the access control system 100 may restrict access, inform the user of the mismatch, notify authorities, offer advice on correcting a mismatch, allow limited access, send messages inside the system, send messages outside of the system, etc., and/or combinations thereof. In one example, a mismatch in data may cause the access control system 100 to prevent access for a certain amount of time. In another example, a mismatch in data can cause the access control system 100 to perform a restricted access function, such as, locking a door, denying access to an area, denying access to a resource (e.g., computational, physical, storage, etc.), denying egress or ingress, and/or denying other access functions. In yet another example, the access control system 100 may allow a certain number of mismatches in data before access is restricted on a temporary and/or permanent basis. The method 300 ends at step 336.

Figure 4:
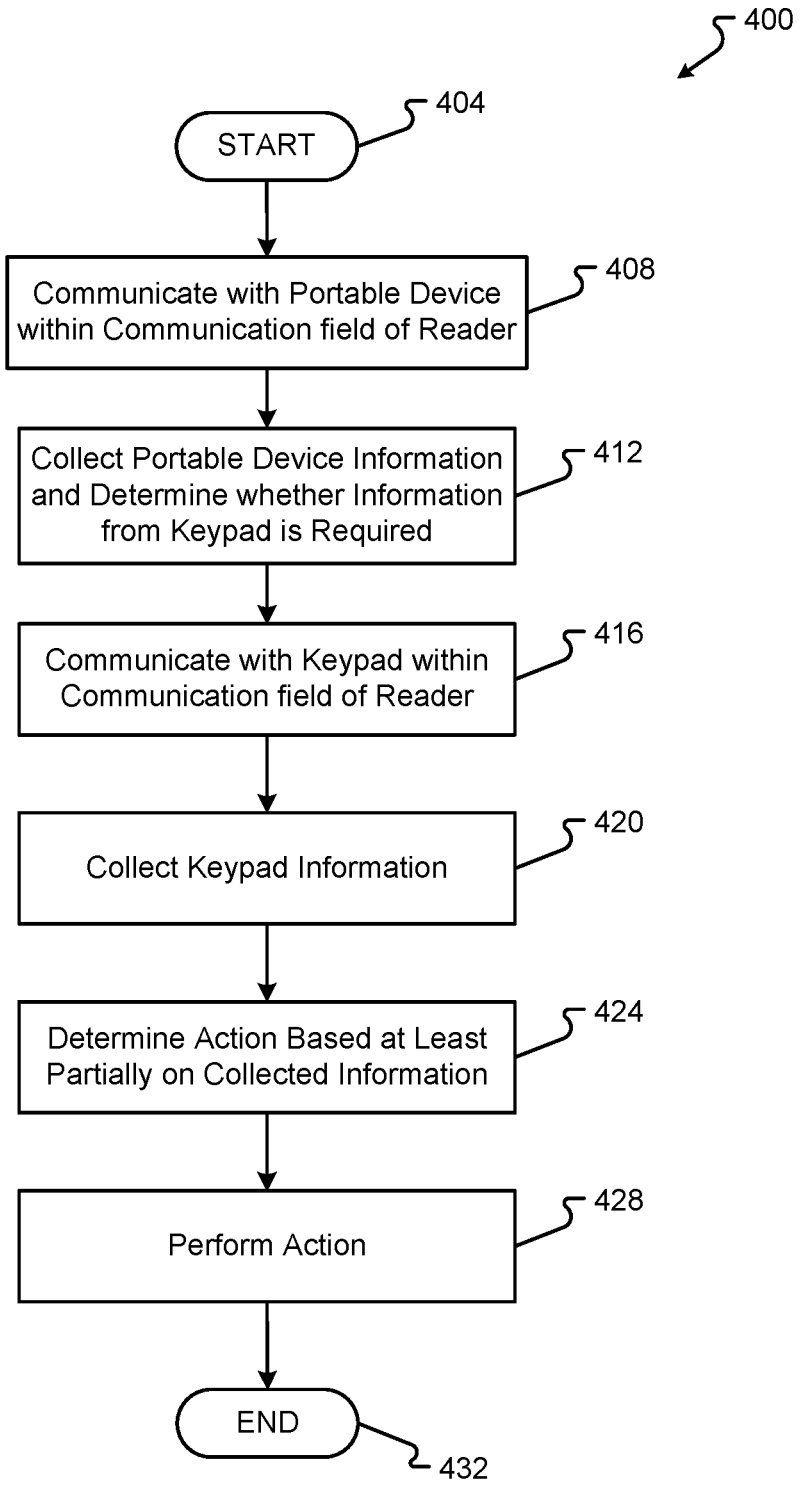
FIG. 4 is a flow chart depicting a second method of communicating with a portable device and retrofit keypad in accordance with embodiments of the present disclosure.

FIG. 4 is a flow chart depicting a second method 400 of communicating with a portable device 108 and retrofit keypad 112 in accordance with embodiments of the present disclosure. While a general order for the steps of the method 400 is shown in FIG. 4, the method 400 can include more or fewer steps or can arrange the order of the steps differently than those shown in FIG. 4. Generally, the method 400 starts with a start operation 404 and ends with an end operation 432. The method 400 can be executed as a set of computer-executable instructions executed by a computer system and encoded or stored on a computer readable medium. Hereinafter, the method 400 shall be explained with reference to the systems, components, modules, software, data structures, user interfaces, etc. described in conjunction with FIGS. 1-3.

The method 400 begins at step 404 and proceeds by communicating with a portable device 108 that is within a communication field of a reading device 104. The portable device 108 may be associated with (e.g., be combined with, a part of, near, and/or adjacent to) a portable device 108, and vice versa, as provided herein. The communication may be performed by at least one reading device 104 of the access control system 100. As can be appreciated, the communication may be initiated by the reading device 104, the portable device 108, and/or other parts of the access control system 100. For instance, in one embodiment of an RF access control system, an RF reading device may provide an electrical field that initiates a communication with an RF portable device. In this example, when the RF portable device enters the electrical field of the RF reading device, communication between the RF portable device and the RF reading device is enabled. In some cases, the electrical field may provide an RF portable device with the necessary power to complete various communications operations.

In some embodiments, the reading device 104 may be a wireless access reader configured to communicate with portable devices 108 using Bluetooth® communications protocols (e.g., Bluetooth®, Bluetooth® low energy (LE), etc.). For example, the portable devices 108 in this embodiment may be mobile phones equipped with Bluetooth® communication hardware and software. Continuing this example, either the mobile phone or the wireless access reader may be the device that initiates commands and/or requests, as provided herein. As can be appreciated, the other device (e.g., the device not initiating commands and/or requests) may be configured to receive the commands and/or requests.

The method 400 continues by collecting information from the portable device 108 (step 412). The collection of information may be made by one or more of the reading device 104, the access server 128, and another part of the access control system 100. Typical information collected from the portable device 108 can include, but is not limited to, credential information, identification information, portable device characteristics, and the like. One example of a portable device 108 can include an RFID card. In this example, the information collected may be credential information that is stored in a memory of the RFID card. Another example of a portable device 108 may include a mobile phone where information (e.g., credential information, identification information, etc.) is stored in a memory associated with the mobile phone (e.g., locally or remotely).

In addition to collecting information associated with the portable device 108, the reading device 108 and/or the access server 128 may determine whether information from a retrofit keypad 112 is required (step 412). This determination may be made based on a configuration of the access control system 100. Additionally or alternatively, the determination may be made based on the information collected from the portable device 108. In one embodiment, the reading device 104, upon reading the portable device 108, may refer to an access server 128 and/or an access data memory 120 for access rules and/or instructions. In some cases, a user may be required to provide additional credential information (e.g., a password, personal identification number (PIN), code, other credential information, etc.) before an access decision can be made by the access control system 100. As provided herein, the additional credential information may be provided by the retrofit keypad 112.

In one embodiment, the retrofit keypad 112 may be attached to a portable device 108. The retrofit keypad 112 may be configured to perform operations that are supplemental to operations of the portable device 108. In the example provided above, where the user is required to provide additional credential information, the user may provide this additional credential information via the retrofit keypad 112. As described above, the retrofit keypad 112 may include a memory 204 that is configured to store credential information. The credential information stored in the memory 204 may be the additional credential information required by the access control system 100.

By way of example, a reading device 104 may be a legacy device associated with an existing access control system. The legacy reader may not include access features that are available in new access control systems, such as multiple authentication techniques, programming, decision making capabilities, and/or the like. In this example, the intelligence surrounding access decisions may be handled by an access server 128 that is in communication with the legacy reader. To use new technology in legacy systems, the programming of the access server 128 and/or rules stored in access data memory 120 may be updated to include new protocols and/or capabilities. Part of this new programming may include how the legacy reader communicates with credentials. In particular, the legacy reader may be instructed to receive information from a first credential (e.g., a portable device 108) and then a second credential (e.g., a retrofit keypad 112) before making a decision on access. Some legacy systems may utilize the access server to receive the information associated with the portable device 108 and the retrofit keypad 112 in determining access actions. If no keypad 112 information is required, the method 400 may end at step 432.

The method 400 continues, when information from the retrofit keypad 112 is required, by communicating with the retrofit keypad 112 within the communication field of the reading device 104 (step 416). In one embodiment, communications may be initiated by the reading device 104 sending an interrogation signal, command, or request to the retrofit keypad 112. In another embodiment, the retrofit keypad 112 may be initiated for communications by a signal sent from the reading device 104. In yet another embodiment, communications may be initiated by pressing at least one key 216A-N of the retrofit keypad 112. The communications between the reading device 104 and the retrofit keypad 112 may include a number of communications protocols and may be configured to suit the specifications/requirements of a particular access control system (e.g., RF, Bluetooth®, Bluetooth® LE, GSM, CDMA, etc.).

In communicating with the retrofit keypad 112, the reading device 104 may collect information from the retrofit keypad 112 (step 420). The information may include one or more of application instructions, signals, codes, data strings, commands, credential information, identification data, and the like. In any event, the information may be sent from the retrofit keypad 112 to the reading device 104 of the access control system 100. In some embodiments, the reading device 104 may send at least some of the information received from the retrofit keypad to the access server 128 for an access decision.

Keypad information may include information provided by a user at the retrofit keypad 112. For example, when a user presses at least one key 216A-N of the retrofit keypad 112, a signal may be sent by the retrofit keypad 112 using at least one antenna 212A-N to the reading device 104. In one embodiment, signals may include information representing a string of data (e.g., a number of keys 216A-N pressed by a user) that are sent together (e.g., in a concatenated string) upon pressing a "send" or "final" key 216A-N of the keypad 112. In some embodiments, the data received may be associated with a time of transmission, reception, and/or combinations thereof. For example, data sent via the keypad 112 may include a timestamp. The timing associated with sending/receiving data can be used to provide various functional operations as described herein.

The method 400 proceeds by determining an action of the access control system 100 based at least partially on the information collected (step 424). This determination may be made by at least one of a reading device 104 and an access server 128 using information collected from the portable device 108, the retrofit keypad 112, and/or combinations thereof. Actions of the access control system 100 may include, but are not limited to, granting access, denying access, limiting access, providing restricted access, comparing credential data, determining matches in credential information, sending a message, initiating a communication with a communication device 132, sending an alarm, sending an alert, establishing an intercom communication, and the like.

As provided above, the timing associated with an input provided at the retrofit keypad 112 may be used in determining a corresponding function. For example, at least one key 216A-N of the retrofit keypad 112 may be configured as a duress button. When the duress button is actuated a duress signal may be transmitted from the retrofit keypad 112 to the reading device 104. The duress button may be associated with a particular key 216A-N of the retrofit keypad 112 and/or a time of actuation in order to provide a duress signal. By way of example, the duress button may be actuated after a portable device 108 (e.g., an ID card, etc.) is read, when a portable device 108 is read, or before a portable device 108 is read by the reading device 104 to provide a duress signal. In any event, the timing of actuation of the duress button may be configured to differentiate the duress function from one or more other functions. These one or more other functions may be associated with the same key 216A-N when actuated at different times. Similar timing logic and/or key allocation may be used to associate a status of a user or condition of an access (e.g., entering an access point, exiting an access point, clocking-in, clocking-out, etc.) with the reading of the retrofit keypad 112 information. This information may be stored in at least one memory of the access control system 100.

In another example, a user may be required to press a key 216A-N of the retrofit keypad 112 at the same time, or substantially the same time, as the retrofit keypad 112 is being read by a reading device 104. In some embodiments, information may not be transmitted from the retrofit keypad 112 to the reading device 104 until a key 216A-N is pressed. Failure to do so in a timely manner may prevent access to an asset. In other words, the access control system 100 may determine that the key 216A-N was not pressed within a predefined time limit of the read performed by the reading device 104, and as such, may deny the user access. In the event that the key 216A-N is pressed in a timely manner (e.g., within the predefined time limit), access may be granted to the user.

Next, the method 400 proceeds by performing the action determined in step 424 (step 428). The action may include sending instructions to locking hardware associated with the access control system 100 (e.g., to actuate, lock, unlock, etc.). Additionally or alternatively, the action may include actions such as alerting a user, sending messages, alerting authorities, etc., and/or other functions/actions as disclosed herein. The method 400 ends at step 432.

The exemplary systems and methods of this disclosure have been described in relation to retrofit keypad devices, systems, and methods. However, to avoid unnecessarily obscuring the present disclosure, the preceding description omits a number of known structures and devices. This omission is not to be construed as a limitation of the scopes of the claims. Specific details are set forth to provide an understanding of the present disclosure. It should, however, be appreciated that the present disclosure may be practiced in a variety of ways beyond the specific detail set forth herein.

Furthermore, while the exemplary aspects, embodiments, options, and/or configurations illustrated herein show the various components of the system collocated, certain components of the system can be located remotely, at distant portions of a distributed network, such as a LAN and/or the Internet, or within a dedicated system. Thus, it should be appreciated, that the components of the system can be combined in to one or more devices, such as a Personal Computer (PC), laptop, netbook, smart phone, Personal Digital Assistant (PDA), tablet, etc., or collocated on a particular node of a distributed network, such as an analog and/or digital telecommunications network, a packet-switch network, or a circuit-switched network. It will be appreciated from the preceding description, and for reasons of computational efficiency, that the components of the system can be arranged at any location within a distributed network of components without affecting the operation of the system. For example, the various components can be located in a switch such as a PBX and media server, gateway, in one or more communications devices, at one or more users' premises, or some combination thereof. Similarly, one or more functional portions of the system could be distributed between a telecommunications device(s) and an associated computing device.

Furthermore, it should be appreciated that the various links connecting the elements can be wired or wireless links, or any combination thereof, or any other known or later developed element(s) that is capable of supplying and/or communicating data to and from the connected elements. These wired or wireless links can also be secure links and may be capable of communicating encrypted information. Transmission media used as links, for example, can be any suitable carrier for electrical signals, including coaxial cables, copper wire and fiber optics, and may take the form of acoustic or light waves, such as those generated during radio-wave and infra-red data communications.

Also, while the flowcharts have been discussed and illustrated in relation to a particular sequence of events, it should be appreciated that changes, additions, and omissions to this sequence can occur without materially affecting the operation of the disclosed embodiments, configuration, and aspects.

A number of variations and modifications of the disclosure can be used. It would be possible to provide for some features of the disclosure without providing others.

Optionally, the systems and methods of this disclosure can be implemented in conjunction with a special purpose computer, a programmed microprocessor or microcontroller and peripheral integrated circuit element(s), an ASIC or other integrated circuit, a digital signal processor, a hard-wired electronic or logic circuit such as discrete element circuit, a programmable logic device or gate array such as PLD, PLA, FPGA, PAL, special purpose computer, any comparable means, or the like. In general, any device(s) or means capable of implementing the methodology illustrated herein can be used to implement the various aspects of this disclosure. Exemplary hardware that can be used for the disclosed embodiments, configurations and aspects includes computers, handheld devices, telephones (e.g., cellular, Internet enabled, digital, analog, hybrids, and others), and other hardware known in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

In yet another embodiment, the disclosed methods may be readily implemented in conjunction with software using object or object-oriented software development environments that provide portable source code that can be used on a variety of computer or workstation platforms. Alternatively, the disclosed system may be implemented partially or fully in hardware using standard logic circuits or VLSI design. Whether software or hardware is used to implement the systems in accordance with this disclosure is dependent on the speed and/or efficiency requirements of the system, the particular function, and the particular software or hardware systems or microprocessor or microcomputer systems being utilized.

In yet another embodiment, the disclosed methods may be partially implemented in software that can be stored on a storage medium, executed on programmed general-purpose computer with the cooperation of a controller and memory, a special purpose computer, a microprocessor, or the like. In these instances, the systems and methods of this disclosure can be implemented as program embedded on personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method of communicating with a retrofit keypad in an access control system, comprising:

receiving data transmitted by a portable device at a reading device of the access control system;

determining, based at least partially on the data transmitted, that access information from the retrofit keypad is required to perform an access function of the access control system;

establishing, via the reading device, a communication with the retrofit keypad;

receiving data transmitted by the retrofit keypad at the reading device of the access control system;

interpreting the data received from the retrofit keypad;

performing an access function based at least partially on whether the data received includes the access information.

2. The method of claim 1, wherein determining that access information from the retrofit keypad is required, further comprises:

determining that the data transmitted includes credential information;

referring to a memory associated with the access control system for an access permission that matches the credential information; and providing, when the access permission matches the credential information and based at least partially on the access permission, an output configured to collect the access information from the retrofit keypad.

3. The method of claim 1, wherein establishing the communication with the retrofit keypad further comprises:

providing a radio frequency (RF) field that is configured to interrogate the retrofit keypad, and wherein the RF field provides at least one of power and a communications channel for the retrofit keypad.

4. The method of claim 1, wherein interpreting the data received from the retrofit keypad further comprises:

comparing, via a processor of the access control system, data in a first portion of the data received to stored access information stored in an access memory of the access control system; and determining, via the processor, whether the data in the first portion of the data received matches the stored access information; and providing, via the processor, a first output when the data in the first portion of the data received matches the stored access information and a second output when the data in the first portion of the data received fails to match the stored access information, and wherein the first and second outputs are different.

5. The method of claim 1, wherein the access information includes at least one of a personal identification number (PIN), a code, supplemental credential information, a security key, and a password.

6. The method of claim 1, wherein performing the access function further comprises:

granting access to an asset of the access control system when the data received includes the access information; and restricting access to an asset of the access control system when the data received does not include the access information.

7. The method of claim 1, wherein the access function includes at least one of granting access, denying access, limiting access, providing restricted access, sending a message, initiating a communication with a communication device, sending an alarm, and establishing an intercom communication.

8. The method of claim 1, wherein the access function performed is based at least partially on a time associated with the data received from the retrofit keypad.

9. The method of claim 1, wherein the time associated with the data received from the retrofit keypad includes a length of time between receiving the data transmitted by the portable device and receiving the data transmitted by the retrofit keypad.

10. The method of claim 1, wherein prior to receiving data transmitted by the retrofit keypad, the method further comprises:

sending, via the reading device, encryption information to the retrofit keypad for an encryption of information sent via the retrofit keypad.

11. The method of claim 10, wherein the encryption information includes at least one substitution cipher configured to alter data input at the retrofit keypad into a scrambled output to the reading device.

12. The method of claim 10, wherein the encryption information is at least partially based on the data transmitted by the portable device.

13. A retrofit keypad, comprising:

at least one user interface key configured to receive input from a user;

at least one wireless antenna operatively connected to the at least one user interface key;

a memory configured to store a communication application, wherein the communication application is configured to interpret the input received via the at least one user interface key and transmit information via the at least one wireless antenna; and a processor operatively connected to the at least one user interface key, the at least one wireless antenna, and the memory, and wherein the processor is configured to execute the communication application.

14. The retrofit keypad of claim 13, having two or more user interface keys and two or more wireless antennas, wherein a first user interface key of the two or more user interface keys is associated with a first wireless antenna of the two or more wireless antennas, wherein a second user interface key of the two or more user interface keys is associated with a second wireless antenna of the two or more wireless antennas, wherein pressing the first user interface key is configured to send a first signal via the first wireless antenna, and wherein pressing the second user interface key is configured to send a second signal via the second wireless antenna.

15. The retrofit keypad of claim 13, having two or more user interface keys, wherein a first user interface key of the two or more user interface keys is associated with a common wireless antenna of the at least one wireless antenna, wherein a second user interface key of the two or more user interface keys is associated with the common wireless antenna of the at least one wireless antenna, wherein pressing the first user interface key is configured to send a first signal via the common wireless antenna, and wherein pressing the second user interface key is configured to send a second signal via the common wireless antenna.

16. The retrofit keypad of claim 13, wherein the at least one user interface key is one or more of a switch, a button, an actuator, and an element displayed to a graphical user interface (GUI) of the retrofit keypad.

17. The retrofit keypad of claim 13, further comprising:

a control switch operatively connected to the processor and the memory of the retrofit keypad, wherein the control switch includes at least two positions, and wherein a state of the retrofit keypad is altered based on a specific position of the control switch.

18. The retrofit keypad of claim 17, wherein the control switch includes a programming position and an operating position of the at least two positions, and wherein the programming position is configured to allow write access to the memory of the retrofit keypad and the operating position is configured to at least partially prevent write access to the memory of the retrofit keypad.

19. The retrofit keypad of claim 13, further comprising:

a power module configured to provide power to electronics of the retrofit keypad.

20. An access control system, comprising:

a retrofit keypad, comprising:

at least one user interface key configured to receive input from a user;

at least one wireless antenna operatively connected to the at least one user interface key;

a memory configured to store a communication application, wherein the communication application is configured to interpret the input received via the at least one user interface key and transmit information via the at least one wireless antenna; and a processor operatively connected to the at least one user interface key, the at least one wireless antenna, and the memory, and wherein the processor is configured to execute the communication application;

a reading device configured to receive the information transmitted via the at least one wireless antenna of the retrofit keypad; and an access processing module, configured to interpret the information received from the retrofit keypad and perform an access function based at least partially on whether the information received includes access information.

* * * * *